US006685213B2

(12) United States Patent
Hauglin

(10) Patent No.: US 6,685,213 B2
(45) Date of Patent: Feb. 3, 2004

(54) TOURING, TELEMARK, OR CROSS-COUNTRY SKI BINDING

(75) Inventor: Bernt-Otto Hauglin, Røyken (NO)

(73) Assignee: Rottefella AS, Klokkarstua (NO)

( * ) Notice: Subject to any disclaimer, the term of this patent is extended or adjusted under 35 U.S.C. 154(b) by 0 days.

(21) Appl. No.: 10/190,326

(22) Filed: Jul. 2, 2002

(65) Prior Publication Data

US 2003/0047912 A1 Mar. 13, 2003

Related U.S. Application Data

(63) Continuation of application No. 09/273,364, filed on Mar. 22, 1999, now abandoned.

(30) Foreign Application Priority Data

Apr. 24, 1998 (DE) ..... 198 18 517

(51) Int. Cl.[7] ..... A63C 9/20
(52) U.S. Cl. ..... 280/624; 280/615
(58) Field of Search ..... 280/615, 614, 280/613, 623, 625, 624, 626

(56) References Cited

U.S. PATENT DOCUMENTS

| | | | | | |
|---|---|---|---|---|---|
| 2,758,846 | A | * | 8/1956 | Swensen | 280/615 |
| 4,659,103 | A | | 4/1987 | Tessaro | 280/615 |
| 4,676,522 | A | * | 6/1987 | Hue | 280/615 |
| 4,768,805 | A | * | 9/1988 | Graillat | 280/615 |
| 4,836,572 | A | | 6/1989 | Pozzobon | 280/615 |
| 4,909,531 | A | | 3/1990 | Graillat | 280/615 |
| 4,915,406 | A | | 4/1990 | Graillat | 280/615 |
| 5,066,036 | A | | 11/1991 | Broughton | 280/615 |
| 5,518,264 | A | * | 5/1996 | Broughton | 280/615 |
| 5,727,808 | A | * | 3/1998 | Broughton | 280/615 |
| 5,794,963 | A | | 8/1998 | Girard | 280/615 |
| 5,897,127 | A | | 4/1999 | Hauglin | 280/615 |
| 5,924,719 | A | | 7/1999 | Girard | 280/615 |
| 5,957,478 | A | | 9/1999 | Vigny | 280/615 |
| 5,992,873 | A | | 11/1999 | Hauglin | 280/615 |
| 6,017,050 | A | | 1/2000 | Girard | 280/615 |
| 6,390,493 | B1 | * | 5/2002 | Hauglin | 280/615 |

FOREIGN PATENT DOCUMENTS

| | | |
|---|---|---|
| DE | 37 08 838 | 9/1987 |
| DE | 195 03 397 | 8/1996 |
| DE | 195 17 791 | 11/1996 |
| WO | 96/23558 | 8/1996 |

* cited by examiner

*Primary Examiner*—Brian L. Johnson
*Assistant Examiner*—Jeffrey Restifo
(74) *Attorney, Agent, or Firm*—Knobbe Martens Olson & Bear LLP

(57) ABSTRACT

A touring, telemark, or cross-country ski binding, comprising a supporting portion to offer support in forward, upward and side directions to the front part of an associated shoe, especially a front sole portion of the same, on a ski or similar piece of sports equipment, further comprising a retaining portion to hold the shoe in the supporting portion such that the heel of the shoe can be lifted freely. The retaining portion includes a clamping portion, especially in the form of a tensioning cable, strap or clamping plate, connected to the ski or binding in the area of the metatarsal zone and engaging the front sole of the shoe behind the metatarsal zone.

9 Claims, 13 Drawing Sheets

TOURING, TELEMARK, OR CROSS-COUNTRY SKI BINDING

RELATED APPLICATIONS

This application is a continuation of Ser. No. 09/273,364, filed Mar. 22, 1999, titled A TOURING, TELEMARK, OR CROSS-COUNTRY SKI BINDING and now abandoned. The entire contents of this prior application are hereby incorporated by reference herein and made a part of this specification.

FIELD OF THE INVENTION

The instant invention relates to a touring, telemark, or cross-country ski binding, comprising a supporting means to offer support in forward, upward and side directions to the front part of an associated shoe, especially a front sole section of the same, on a ski or similar piece of sports equipment, further comprising a retaining means to hold the shoe in the supporting means such that the shoe heel can be raised freely.

BACKGROUND OF THE INVENTION

Ski bindings of this kind are known in general. Reference is made, for the sake of example, to the applicant's WO 96/23558. With this known design, the sole is supported in the region of the forward sole end and, therefore, contact between shoe and ski or the like sports equipment will get lost as the heel of the shoe is raised higher. As a consequence, control stability and efficiency in the transfer of force will suffer.

Considerable improvement over this prior art is obtained with bindings designed according to DE 195 17 791 A1 and DE 195 03 397 A1 the origin of which likewise is the applicant of the instant application. Those designs are characterized in that the point of engagement of the retaining means, embodied either by a tensioning cable or a pliable tensioning strap, is located at the sole of the ski shoe in the region of the plantar arch or just ahead thereof in order to hold the shoe in the supporting means. As a result, the shoe heel can be lifted much more easily and higher without compromising ski control and force transfer to the ski.

In the case of the binding according to DE 37 08 838 A1 the shoe is held firmly on the ski by almost its entire front sole. This structure obstructs the free lifting of the heel of the shoe.

SUMMARY OF THE INVENTION

Starting from the state of the art as established by the applicant, it is the object of the instant invention to design the binding such that still better allowance will be made for the principles of ergonomics. More specifically, it is an object of the instant invention to adapt the binding even better to the natural course of motion of the foot, as the heel is lifted. It is another object of the invention to achieve great lateral stability and stability of control as well as good transfer of force, at the same time.

One aspect of the invention involves a touring, telemark, or cross-country ski binding. The binding includes a supporting means and a retaining means. The supporting means offer support in forward, upward and side directions to a front part of an associated shoe. The retaining means are connected to the supporting means and hold the shoe in the supporting means such that a heel of the shoe can be raised freely. The retaining means include a clamping means selected from a group including a tension cable and clamping plate. The clamping means is pivotably connected to the supporting means in an area of a metatarsal zone and configured to pivot about an axis located above the lower surface of the front sole of the shoe. The clamping means is configured to engages a front part of the shoe behind the metatarsal zone.

Another aspect of the invention involves a binding for a touring, telemark, or cross-country ski. The binding comprises a supporting portion to offer support to a front part of an associated shoe in a forward, upward and lateral direction with respect to the ski. The binding further comprises a retaining portion for holding the shoe in the supporting portion. The retaining portion comprises a clamping portion pivotably connected to the supporting portion in an area of the metatarsal zone for engaging the shoe at a location rearward of a metatarsal zone of the shoe. The retaining portion permits the metatarsal zone of the shoe to move upward with respect to an upper surface of the ski. The clamping portion is configured to pivot about an axis located above the lower surface of the front sole of the shoe.

As regards the ergonomic course of movement, it is of particular significance that the retaining means comprises a tensioning or clamping means, e.g. in the form of a tensioning cable, strap, or rigid clamping plate, or the like which is connected to the ski or binding or to the casing of the latter, especially pivotably connected, in the area of the metatarsal zone so as to engage the front sole of the shoe behind the metatarsal zone. As the shoe heel is raised, this tensioning or clamping means permits free and unobstructed downward curving of the front sole of the shoe. In this manner the heel of the shoe can be lifted without constraint, while the foot arches downwardly in accordance with the natural roll-off motion when walking. Simultaneously, high lateral stability and stability in controlling the ski as well as good transfer of force to the ski are achieved due to the fact that the sole is attached at the forward sole end, on the one hand, and at the rear end of the front sole, on the other hand. This kind of attachment of the shoe likewise contributes to the substantially unobstructed raising of the heel of the shoe, to be accomplished at relatively little investment of energy. And, above all, the heel can be raised much higher than with conventional cross-country or touring ski bindings equipped with retaining means which act on the heel of the shoe.

The additional attachment of the shoe obtained by a retainer which is effective behind the metatarsal zone improves the stability in controlling the ski without losing the mobility of the shoe to raise the heel. Efficient introduction of force and transfer thereof to the piece of sports equipment are achieved by these means. Moreover, testing has confirmed that when using a binding according to the invention the comfort in moving ranks very high. Since the fixing of the shoe in accordance with the invention conforms to the anatomy, its application causes no complaints and helps save energy.

Advantageous embodiments of the design principle according to the invention are defined herein, as mentioned above. Thus, two basic structures of the retaining means are conceivable. One is characterized in that the retaining means is movable as a whole in longitudinal direction of the shoe from a shoe release position to a shoe holding position and vice versa, serving as a shoe clamping means at the same time. In the case of the alternative design, the retaining means is mounted so as to be stationary in longitudinal direction of the shoe. In this case it comprises a separate tensioning or clamping means which is movable back and forth in longitudinal direction of the shoe. This means may be embodied by a tensioning cable, a strap, or the like to hold the shoe on the associated supporting means.

The retaining means preferably is supported for pivoting movement about an axis extending transversely of the longitudinal direction of the shoe and approximately parallel to the tread, in other words approximately horizontally. Hereby an exact sole bending line is defined at the place of the metatarsal zone. The pivot axis preferably lies at the level of the front sole, especially also below it, so that the angulation of the foot will correspond to the anatomy when the heel is raised.

Another alternative, specifically one of very simple structure, is characterized in that the supporting means comprises a toe iron including wedges which project only over the forward sole end, and the retaining means comprises a tensioning cable coupled to a cocking lever or similar cocking member. The tensioning cable is held for longitudinal displacement at deflector members (e.g. in the form of outwardly and downwardly curved, i.e. downwardly open baffles) which are disposed at the outside of both side jaws of the toe iron. The tensioning cable is deflectable in upward direction when the heel of the shoe is raised. Preferably, two or more cable deflector members each are arranged at the outside of both side jaws of the toe iron, at different levels and/or different longitudinal locations, whereby the position in longitudinal direction and/or height of the cable deflection is adjustable individually.

Moreover, regardless of the concept of the invention mentioned above, it is advantageous if the retaining means, in particular the sole clamping means associated with it, is connected at variable height to the ski or binding or to the casing of the binding. This applies especially to its pivot axis, in cases where the retaining means is pivotably connected to the ski or binding. This permits individual adjustment of the tensioning force, especially the return force by which the retaining means acts on the shoe.

If the retaining means is embodied by a rigid sole plate, the latter preferably is located slightly deeper than the sole supporting surface in the area of the supporting means associated with the front sole section so that, when the shoe heel is raised, the front sole can curve downwardly substantially without obstruction behind the hinge point of the sole plate. Furthermore, With this design the sole is maintained substantially in flat orientation between the metatarsal zone and the heel of the shoe. Between the metatarsal zone and the plantar arch, more specifically, this is accomplished by the rigid sole plate, and between the plantar arch and the shoe heel by the sole and shoe structure proper which is rather rigid here.

Two alternatives should be emphasized as regards the support of the shoe in upward direction. The first alternative is characterized in that the front part of the shoe is supported upwardly only in the range of the forward sole end, in particular directly at the forward sole end. With the other alternative, the supporting means firmly holds the shoe or its sole on the ski or similar sports equipment, starting from the forward sole end approximately up to the metatarsal zone.

As already mentioned above, special attention should be paid to the step-in structure When the binding is in release position, with this design, the tensioning or clamping means of the retaining means is held in a position at which it is swung upwardly by an elastically biased toggle lever mechanism. As one steps into the binding and puts down the shoe, one causes the toggle lever mechanism to adopt a bottom ultra dead center position at which the tensioning or clamping means is shifted to and held in shoe closing position. In a particular embodiment, the toggle lever mechanism is composed of a rear lever extending parallel to the longitudinal direction of the ski and pivotably connected to the ski or binding, and a front lever also extending parallel to the longitudinal direction of the ski and being pivotably connected, on the one hand, to the front end of the rear lever and, on the other hand, to the tensioning or clamping means which is supported for longitudinal displacement. The tensioning or clamping means of the retaining means rests on the front lever of the toggle lever mechanism, preferably on the top of the front lever. With the binding in release position, the two levers of the toggle lever mechanism are angled upwardly, approximately defining a V, so that the hinge connection between the two levers lies above the ultra dead center line. In the bottom ultra dead center position, the hinge connection between the two levers is located below the ultra dead center line. The elastic biasing of the toggle lever mechanism is accomplished by a helical compression spring linked, at one end, to the common hinge connection between the front and rear levers and, at the other end, to a stationary part of the binding or casing of the binding in front of the toggle lever mechanism. In the bottom ultra dead center position, the hinge connection between the two levers is located somewhat less below the ultra dead center line than it is located above the ultra dead center line in the release position of the binding. For this reason the helical compression spring is compressed when in the bottom ultra dead center position, whereby the desired elastic bias is produced. Relief of the bias can be obtained by a simple opening mechanism which acts on the common hinge connection between the two levers while, at the same time, the common hinge connection moves into the top ultra dead center position. The opening mechanism is characterized by an opening means which is coupled to a lever or similar operating member disposed in front of or behind the shoe. Upon actuation of the operating member the toggle lever mechanism thus can be moved out of a bottom ultra dead center position. The opening means, for instance, may include a wedge supported so as to be longitudinally displaceable and having one wedge face which is adapted to be moved against the hinge axis interconnecting the front and rear levers and simultaneously lifts the same to pass the ultra dead center line.

BRIEF DESCRIPTION OF THE DRAWING

Preferred embodiments of the binding structure according to the invention will be described in greater detail below with reference to the accompanying drawings, in which.

DESCRIPTION OF THE PREFERRED EMBODIMENTS

Figure 1:
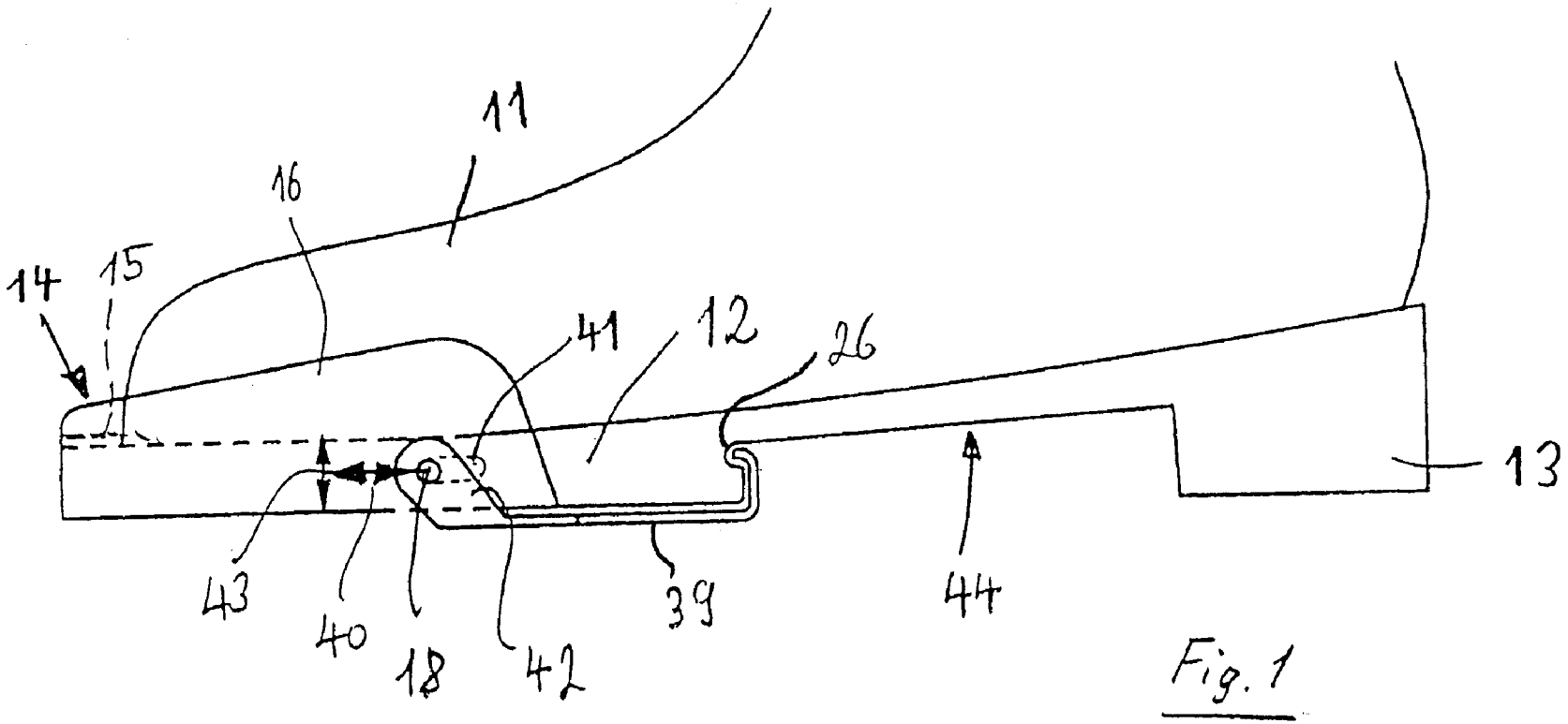
FIG. 1 is a diagrammatic side elevational view of a first embodiment of a touring or telemark binding according to the invention.

The components which all embodiments have in common are designated by the reference numerals below:

10 ski

11 ski shoe

12 front sole

13 shoe heel

14 abutment of the binding associated with the forward sole end to support the shoe towards the front and, possibly, to the sides (supporting means)

15 supporting member to support the front sole in upward direction, e.g. in the form of wedges projecting over the front sole.

The components mentioned above being structural members or elements of the system of a touring, cross-country, or telemark binding which are known in general, need not be described in detail here. It should merely be noted that in the embodiments illustrated in FIGS. 1 to 10 the supporting member 14 is embodied by a so-called toe iron, including side jaws 16 which give lateral support to the shoe. Again, this is a conventional component part which need not be described in detail here.

Figure 2:
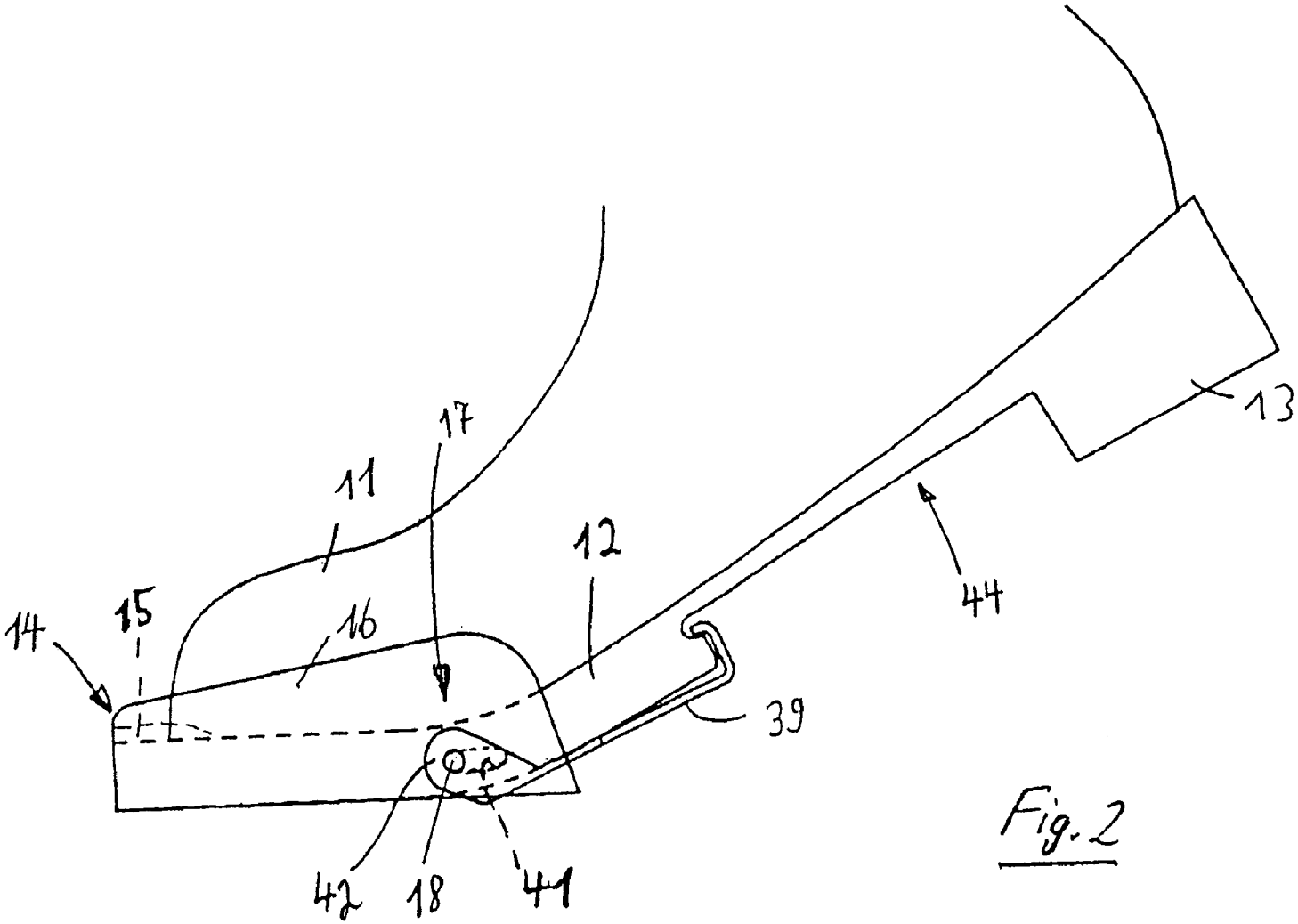
FIG. 2 shows the binding of FIG. 1 with a raised shoe heel.

Moreover, the first embodiment illustrated in FIGS. 1 and 2 is characterized in that the retaining means by which the shoe 11 is held in the supporting means 14 in such manner that the shoe heel 13 is free to be lifted, as shown in FIG. 2, is formed by a rigid clamping plate 39 which is pivotable, in the region of the metatarsal zone 17, about an axis 18 extending horizontally or parallel to the tread of the front sole 12 and transversely of the longitudinal direction of the shoe, as may be gathered from FIGS. 1 and 2. Furthermore, the clamping plate 39 is movable back and forth in longitudinal direction, as indicated by double arrow 40. To this end, oblong holes 41 are formed in the two side jaws 16 of the toe iron 14. Within the oblong holes, journals defining the pivot axis 18 are supported at the inside faces of side lobes 42 of the clamping plate 39 so as to be displaceable longitudinally.

The double arrow 43 in FIG. 1 indicates an adiditional possibility of adjustment of the level of the pivot axis 18, such as by two or more oblong holes 41 provided one above the other.

The clamping plate 39 is coupled to a cocking mechanism (not shown), for example, to a cocking lever disposed in front of the toe iron 14, the coupling being effected via a rigid force transfer element, such as a linkage supported for longitudinal displacement underneath the toe iron and connected, at one end, to the clamping plate 39 and at the other end to the cocking lever mentioned.

The clamping plate 39 is illustrated in closed position in FIGS. 1 and 2. The rear end of the clamping plate 39 is bent forwardly in U shape. It enters into a recess or undercut 26 of corresponding or complementary shape formed at the rear end of the front sole 12, in other words directly in front of the shoe arch 44, as may be taken from FIGS. 1 and 2. The clamping plate 39 extends below the tread of the front sole 12 when the shoe is set down. The front half of the clamping plate 39 is recessed so as to avoid collision of the rear end of the toe iron 14 with the clamping plate 39. Thus the clamping plate 39 is free to swing without collision in upward direction, as shown in FIG. 2, when the shoe heel 13 is raised.

In the embodiment shown, the pivot axis 18 of the clamping plate 39 lies approximately midway of the height of the front sole 12. As briefly stated above, it may also be positioned somewhat higher or lower, preferably by the provision of corresponding oblong holes 41.

Figure 3:
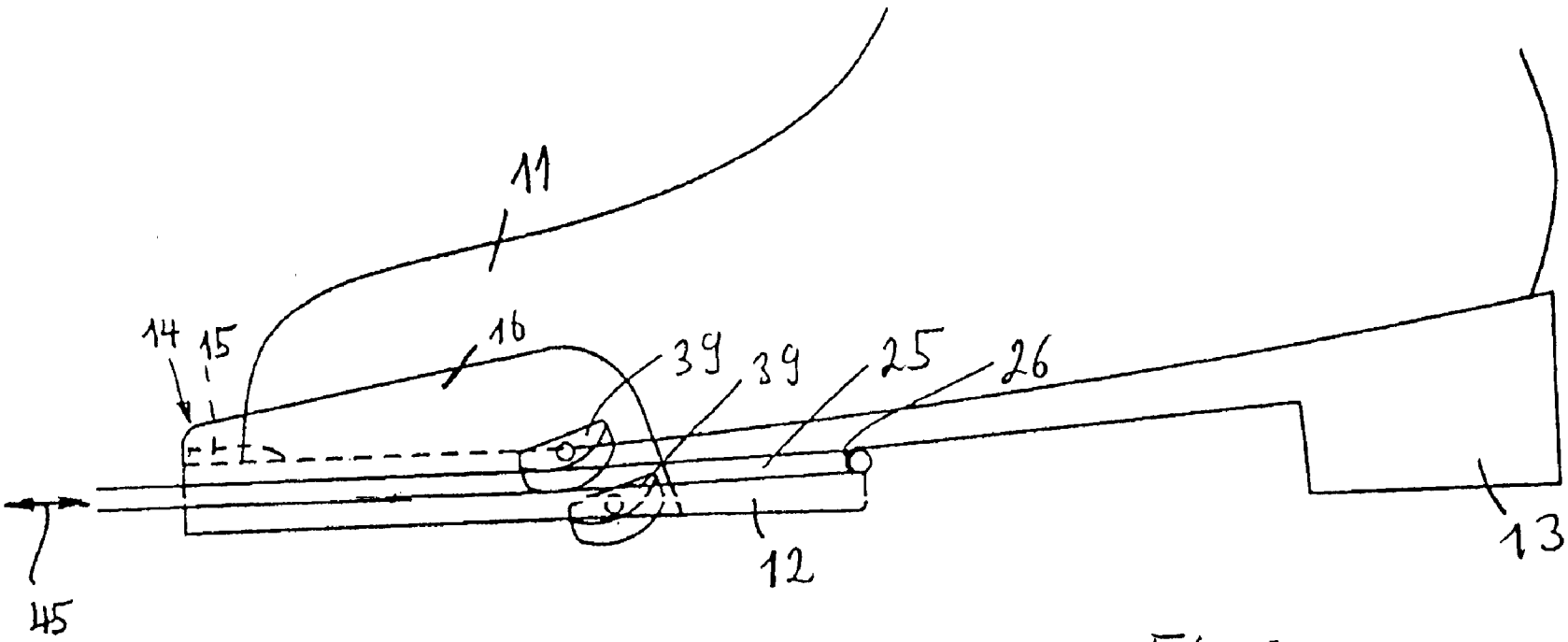
FIG. 3 is a diagrammatic side elevational view of a second embodiment of a binding according to the invention.
Figure 4:
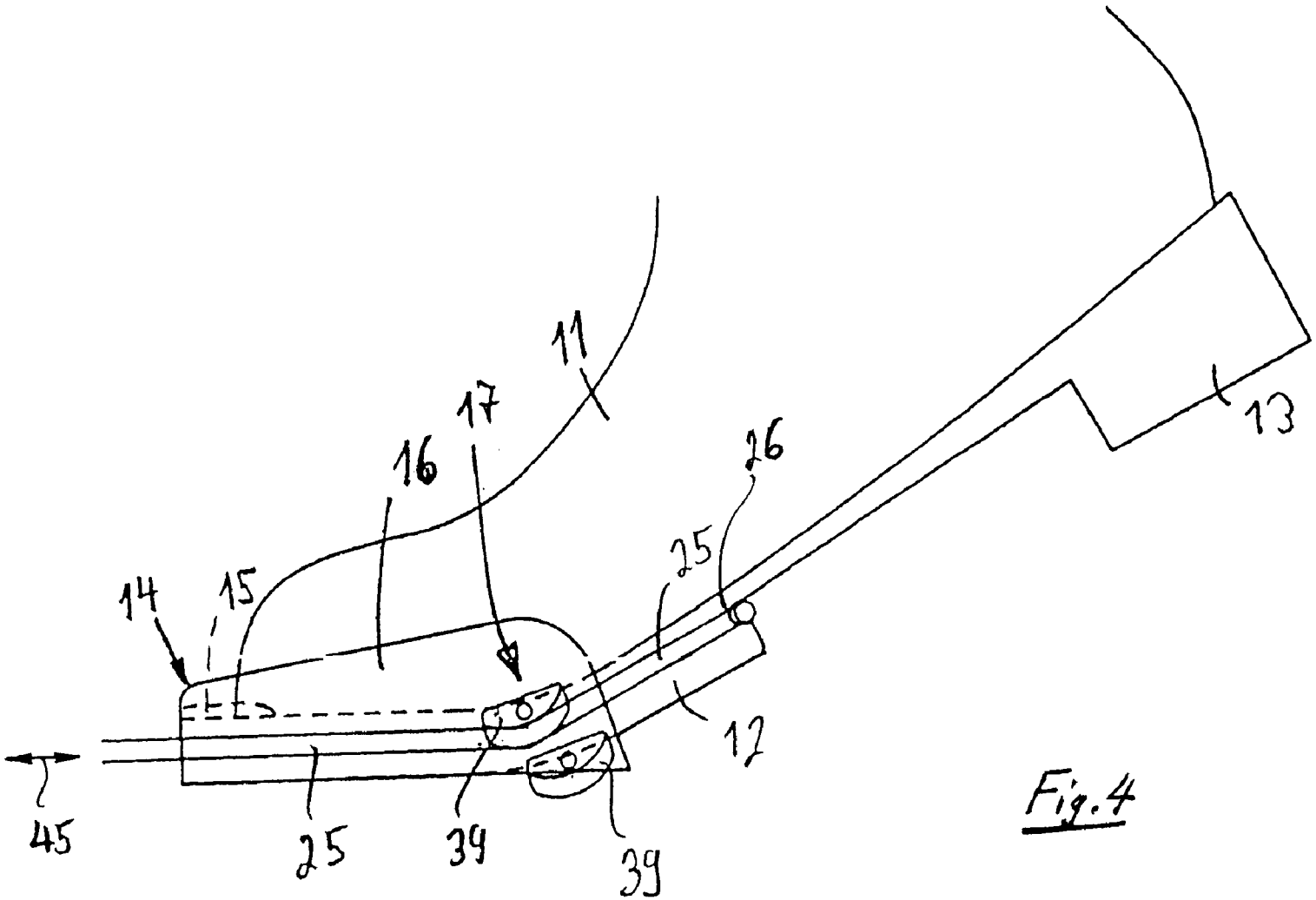
FIG. 4 shows the binding of FIG. 3 with a raised shoe heel.

The embodiment shown in FIGS. 3 and 4 differs from the one according to FIGS. 1 and 2 practically only in that the relatively rigid clamping plate 39 is replaced by a tensioning cable 25 which is held for longitudinal displacement (double arrow 45) at the outside of each of the two side jaws 16 of the toe iron 14 and is deflectable in upward direction when the shoe heel 13 is raised, as may be gathered from FIG. 4. More specifically, two deflector members 39' are arranged at the two side jaws 16 of the toe iron 14, both at different heights and different longitudinal locations so that the place of cable deflection in terms of both level and longitudinal location can be adjusted individually. In front of the toe iron 14, the tensioning cable 25 is connected to an operating mechanism of a kind which is conventional with cable bindings. At one side, the tensioning cable 25 may comprise an additional tension spring member in order to be maintained in closed position under elastic bias. At the face of the sole, the tensioning cable 25 engages in an undercut 26 formed at the rear end of the front sole 12.

Figure 5:
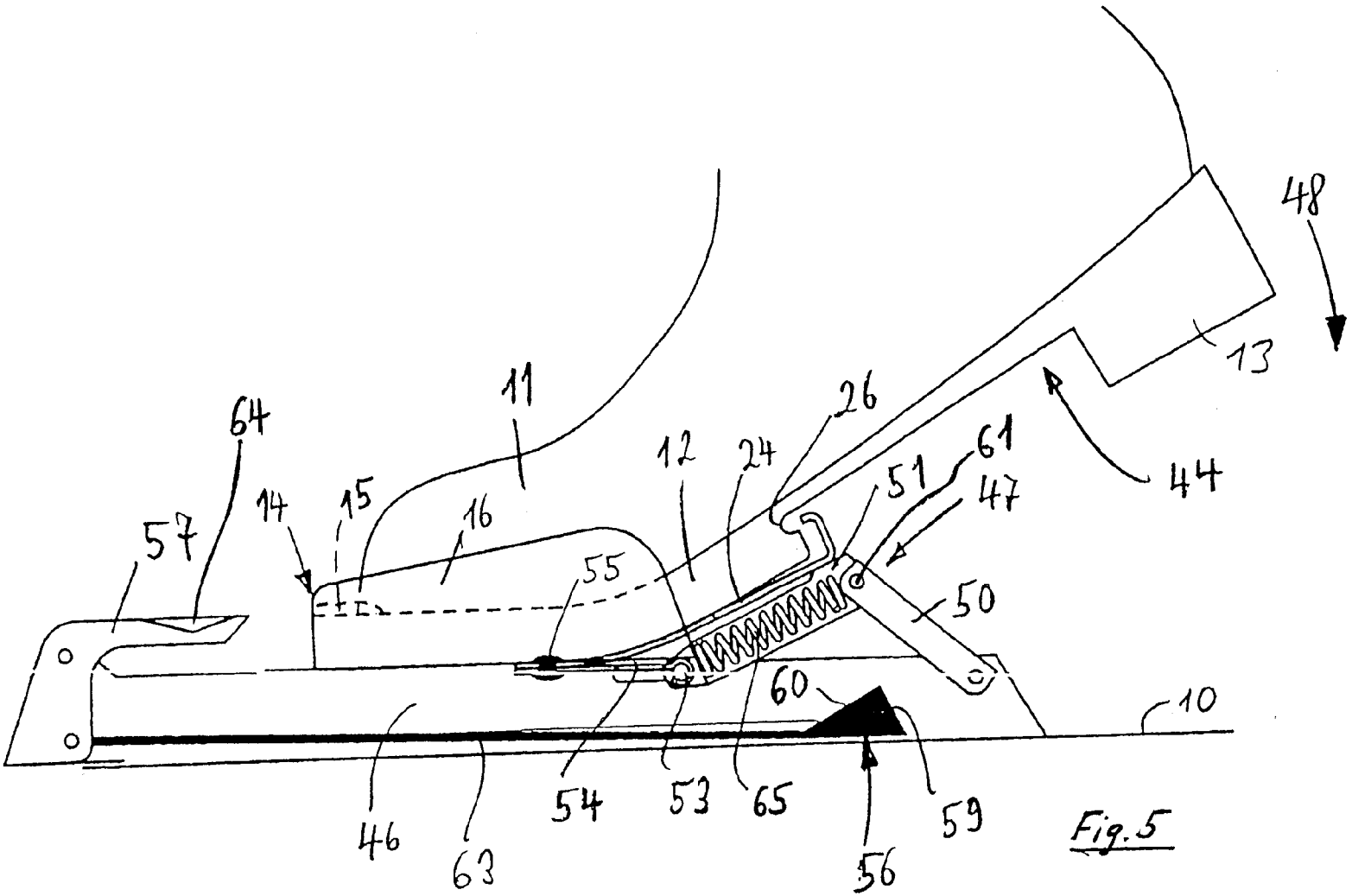
FIG. 5 is a side elevational view of a third embodiment of a binding according to the invention, just before the binding is entered into (step-in binding)
Figure 6:
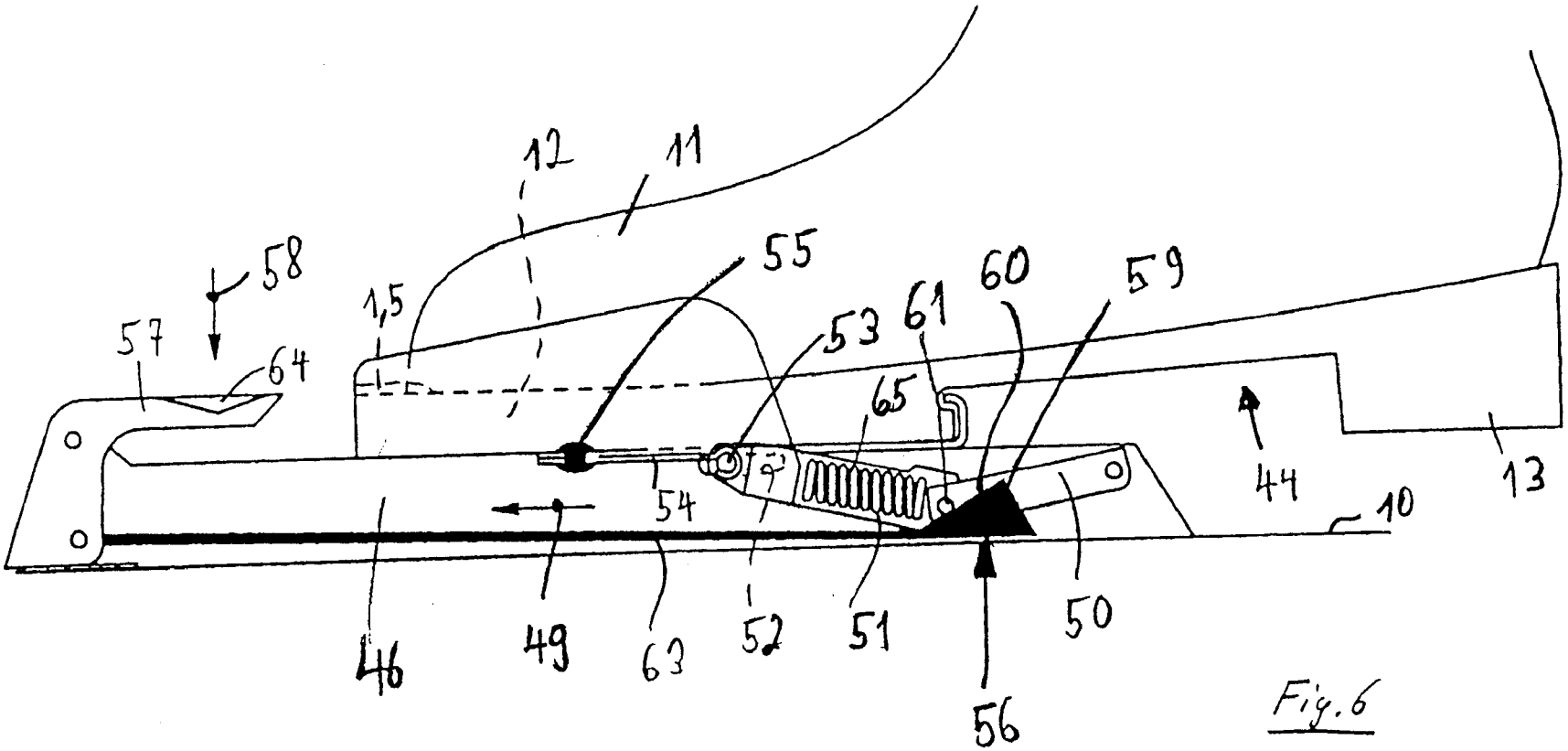
FIG. 6 shows the binding of FIG. 5 upon entry, i.e. in closed position.
Figure 7:
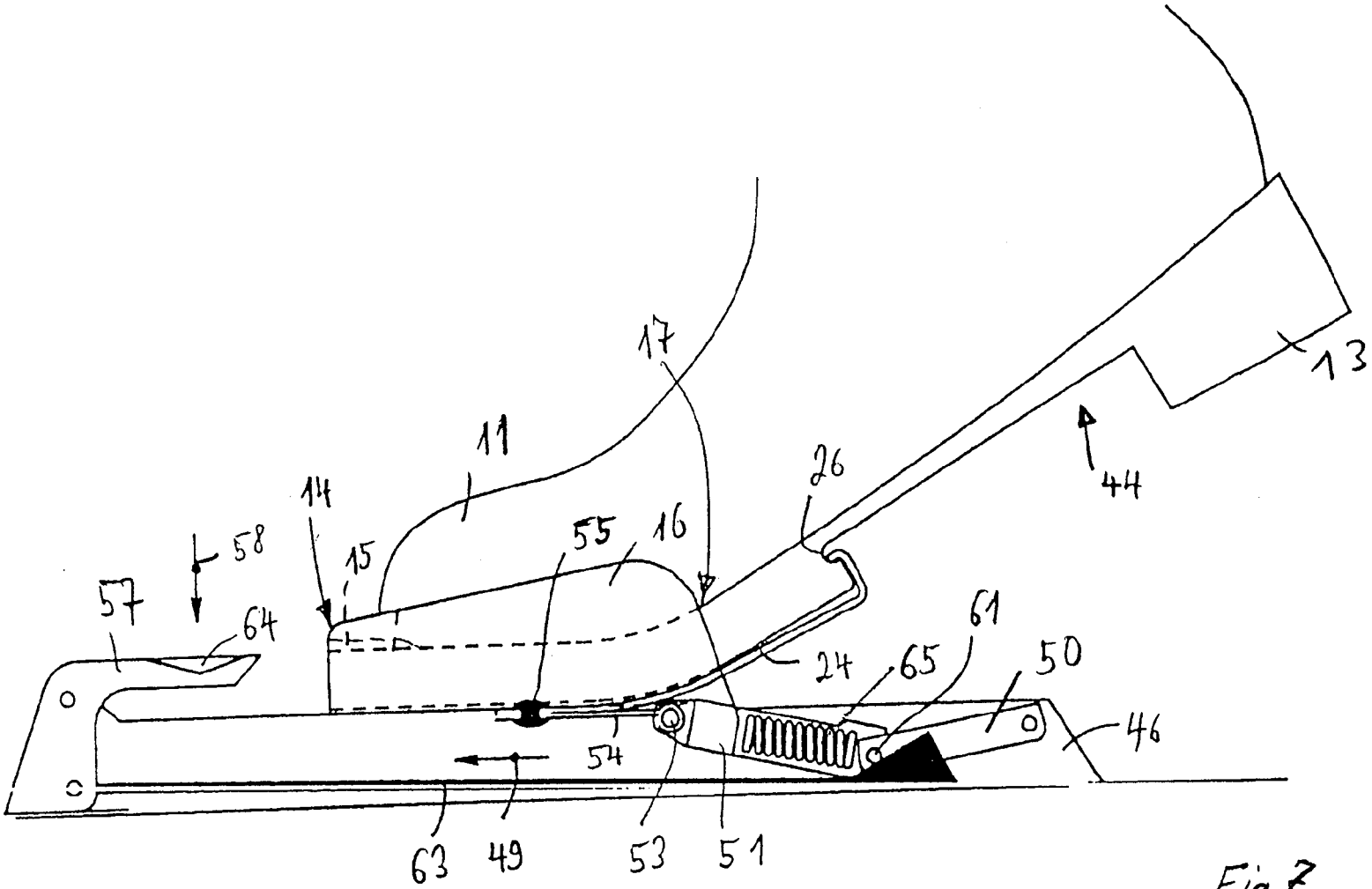
FIG. 7 shows the binding of FIG. 5 in closed position and with a raised shoe heel.
Figure 8:
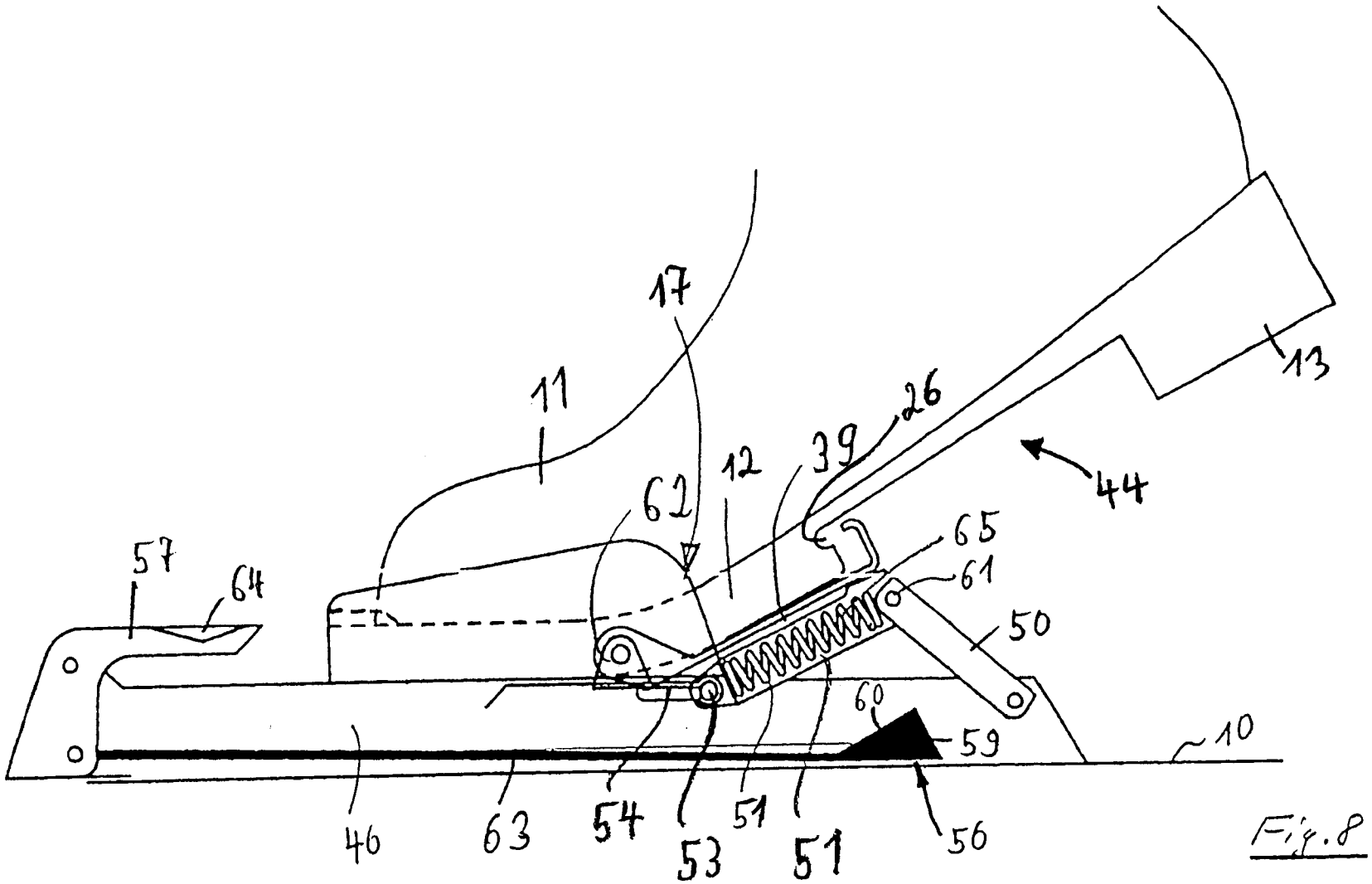
FIG. 8 is a diagrammatic side elevational view of a modification of the binding shown in FIGS. 5 to 7, just before the binding is entered into (step-in binding)
Figure 9:
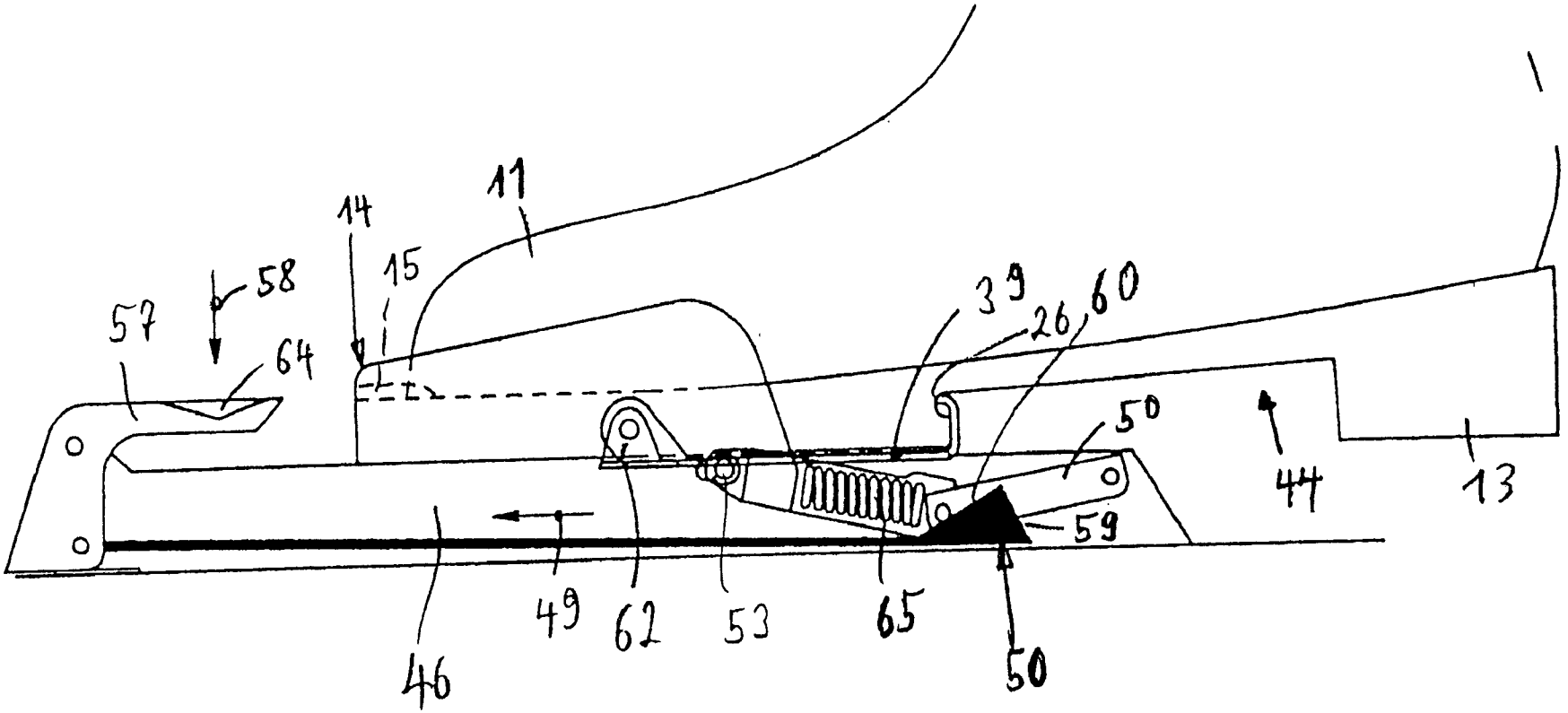
FIG. 9 shows the binding of FIG. 8 in closed position.
Figure 10:
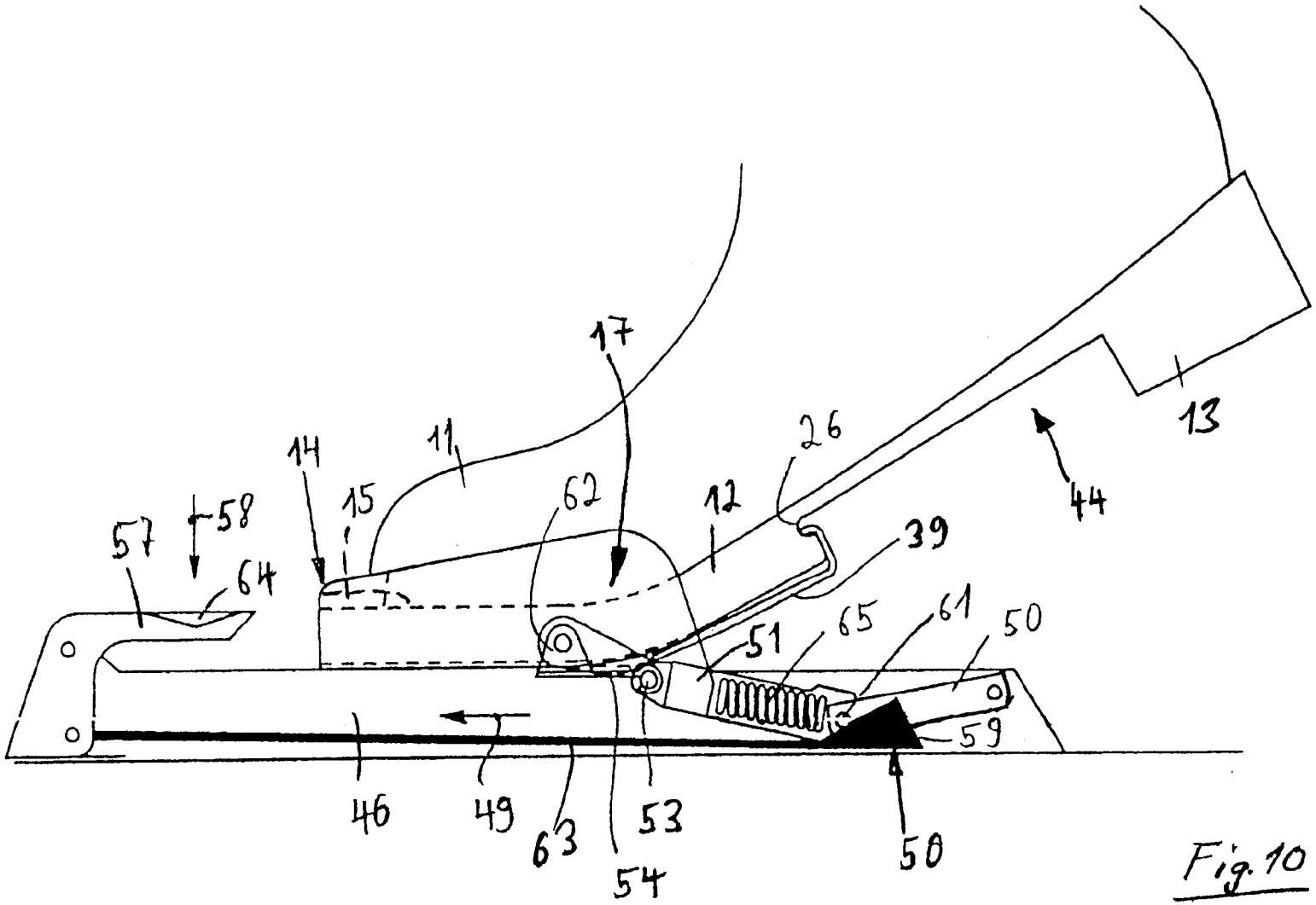
FIG. 10 shows the binding of FIG. 8 in closed position and with a raised shoe heel.

FIGS. 5 to 7 illustrate a novel step-in binding in combination with a retaining means similar to the one according to FIGS. 1 and 2. In contrast to the embodiment shown in FIGS. 1 and 2, however, the retaining means is embodied by a pliable strap 24 which is supported for longitudinal displacement in a casing 46 of the binding. A supporting means 14 in the form of a toe iron is mounted at the top of the casing 46. The strap 24, more specifically, is supported so as to be longitudinally displaceable between the base plate of the toe iron 14 and the top of the casing 46 of the binding. The rear end of the strap 24 is bent forwardly in U shape, in a manner similar to the rear end of the clamping plate 39 according to FIGS. 1 and 2. The front sole 12 and the strap 24 cooperate in the manner as described with reference to FIGS. 1 and 2. When the binding is in release position an elastically biased toggle lever mechanism 47 holds the strap 24 in a position in which it is swung upwardly, more specifically bent upwardly, as may be taken from FIG. 5. As one steps into the binding and puts down the shoe 11 in the direction of arrow 48, the toggle lever mechanism 47 moves into a bottom ultra dead center position, illustrated in FIG. 6, at which the strap 24 is shifted to and locked in closed position. This shifting of the strap 24 into closed position is indicated by arrow 49 in FIG. 6.

The toggle lever mechanism 47 comprises a rear lever 50 which extends parallel to the longitudinal direction of the ski and is pivotably connected to the casing 46 of the binding. It further comprises a front lever 51 likewise extending parallel to the longitudinal direction of the ski and being pivotably connected, one the one hand, to the strap 24 which is supported for longitudinal displacement and, on the other hand, to the front end of the rear lever 50. The strap 24 rests on top of the front lever 51 of the toggle lever mechanism. More specifically, the rear end of the strap 24 is supported on a projection standing up from the rear end of the front lever 51.

The pivot axis 53 associated with the front end of the front lever 51 is supported so as to be longitudinally displaceable within an oblong passage 52 formed in the casing 46 of the binding. Moreover, a flat member 54 links the pivot axis 53 to the front end of the strap 24, the connection being made in this case by a rivet 55.

An opening means 56 likewise is associated with the toggle lever mechanism 47. It is coupled to an operating lever 57 disposed in front of the shoe 11 or toe iron 14. Upon actuation of the operating lever in the direction of arrow 58 in FIG. 6 the toggle lever mechanism 47 moves out of its bottom ultra dead center position into the top ultra dead center position, as illustrated in FIG. 5. The opening means 56 comprises a wedge 59 which is supported for longitudinal displacement and has one wedge face, namely the front wedge face 60 adapted to be moved into contact with the hinge axis 61 interconnecting the front and rear levers, lifting the same to pass the ultra dead center line which is defined by a connecting line between the front and rear pivot points of the front and rear levers.

In the embodiment according to FIGS. 5 to 7 the tensioning or clamping means is a springy strap 24. In the embodiment according to FIGS. 8 to 10 the tensioning or clamping means is a clamping plate 39 supported so as to be longitudinally displaceable, in correspondence with the clamping plate used with FIGS. 1 and 2. In this particular case the clamping plate 39 is supported so as to be pivotable about a bearing bracket 62 which itself is supported for longitudinal displacement. The bearing bracket 62 again is connected by a flat member 54 to the front pivot axis 53 of the front lever 51.

A rigid linkage 63 supported for longitudinal displacement within the casing 46 of the binding connects the opening wedge 59 to the operating lever 57.

The operating lever also might be disposed behind the heel of the shoe. In that case the opening mechanism would be of the same kind but would operate in opposite direction.

The upper surface of the operating lever 57 is formed with a hollow for the tip of the ski pole so that it is easy to open the binding by pressing the ski pole in the direction of arrow 58, without the skier having to bend down.

With all the embodiments described above, the front sole 12 is retained only at the forward sole end by wedges 15 projecting over the same. The wedges 15 are formed at the inside of the side jaws 16 of the toe iron 14.

Figure 11:
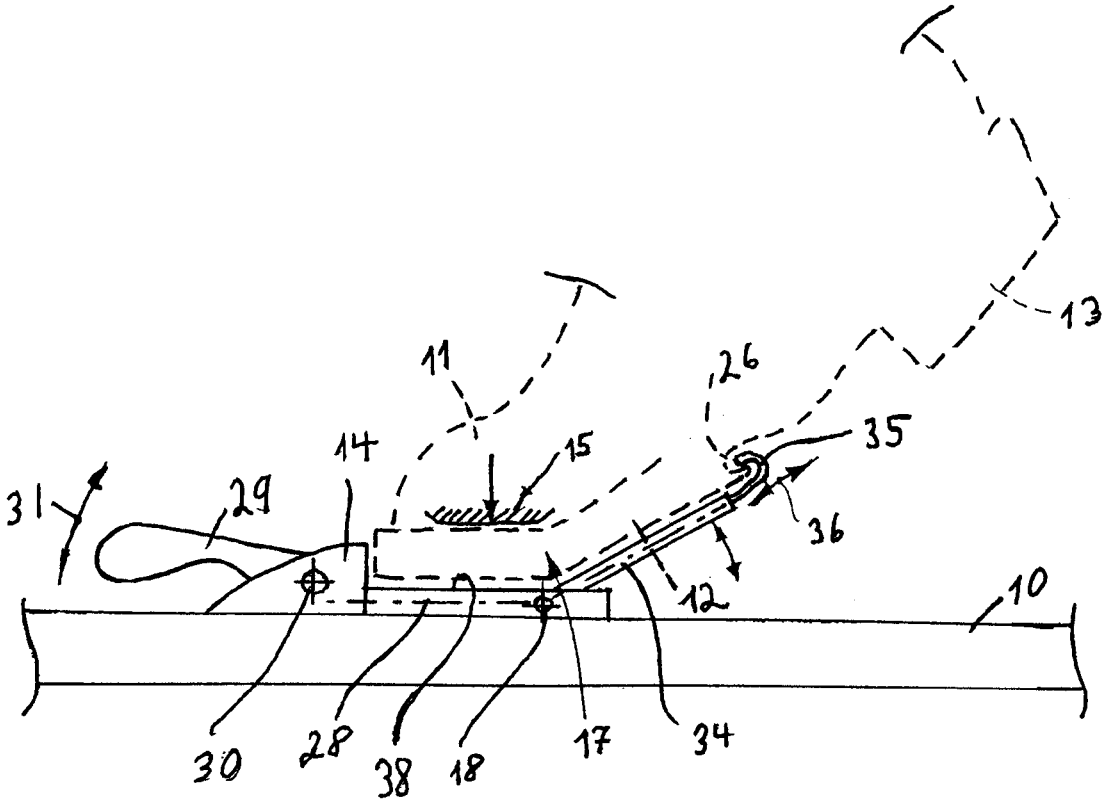
FIG. 11 is a diagrammatic side elevational view of a fourth embodiment of a binding according to the invention.
Figure 12:
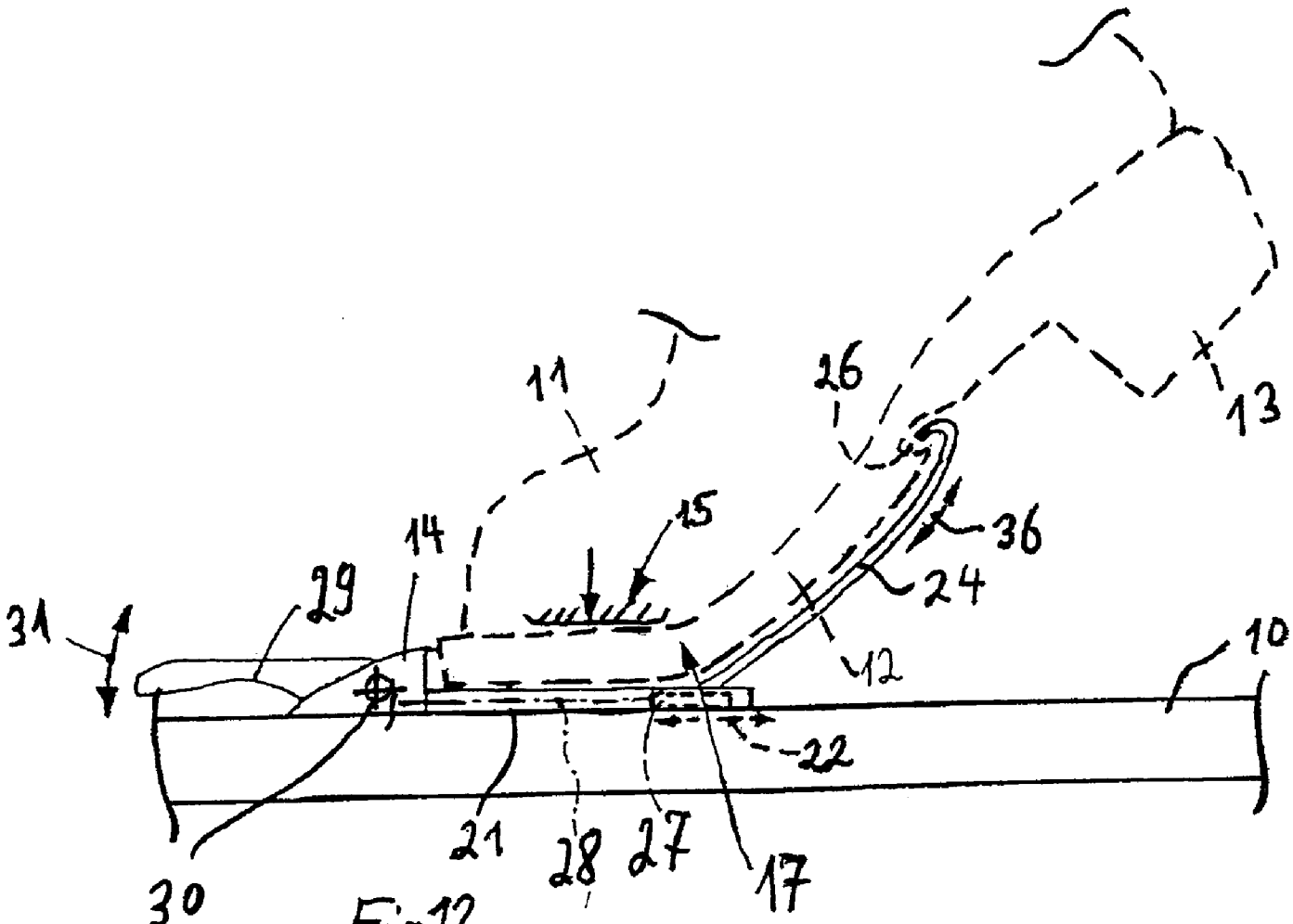
FIG. 12 is a diagrammatic side elevational view of a fifth embodiment of a binding according to the invention.
Figure 13:
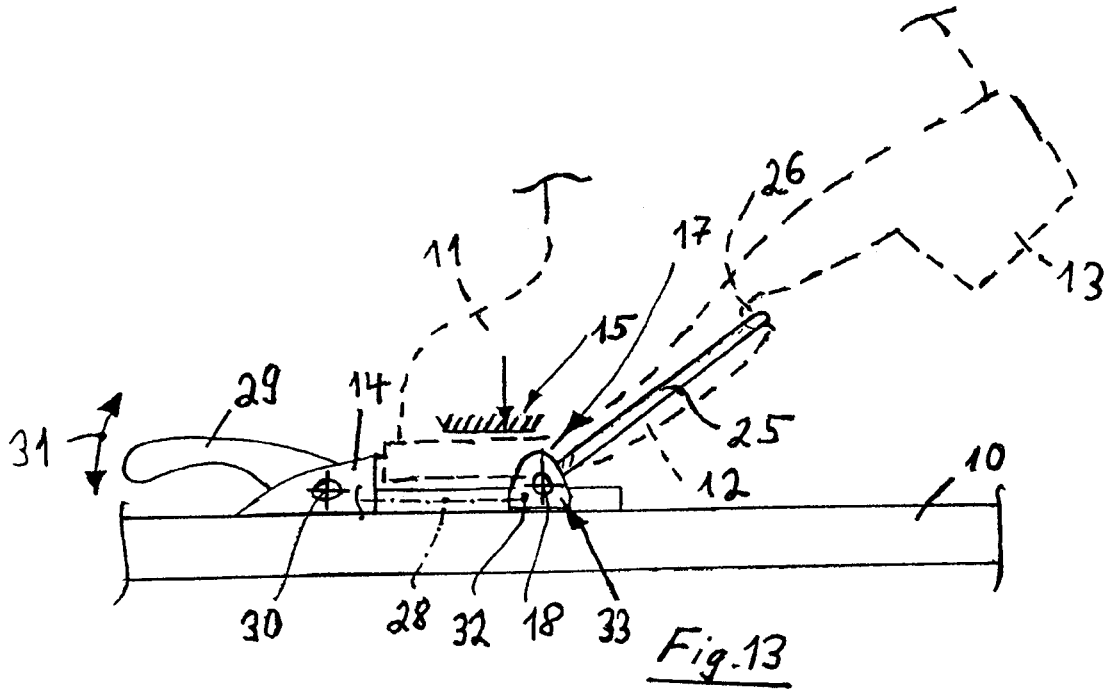
FIG. 13 is a diagrammatic side elevational view of another embodiment of a binding according to the invention.

The embodiment presented in FIG. 11 is characterized in that the wedges 15 of the toe iron have been shifted so far to the rear that the front sole 12 is retained on the ski 10 up to the metatarsal zone 17. In this manner the front sole 12 can be bent only from the metatarsal zone 17 on, when the shoe heel 13 is lifted. The design of the embodiments shown in FIGS. 12 and 13 is similar in this respect.

Essentially, the various embodiments differ only by comprising different retaining means, while it is common to all the retaining means that they are disposed in the region of the metatarsal zone 17, being mounted for flexing or pivoting motion about an axis 18 which extends transversely of the longitudinal direction of the shoe approximately parallel to the tread of the sole or horizontally. The connection preferably is realized as a pivotable support. Furthermore, it is common to all the retaining means that they are adapted to be linked to the rear end of the front sole, especially in the area of transition towards the arch of the shoe.

In the case of the embodiment illustrated in FIG. 11 the retaining means comprises a sole plate 34 which is supported in the metatarsal zone 17 so as to be pivotable about a horizontal transverse axis 18. A longitudinally movable (double arrow 36) sole clamping means 35 is adapted to be deflected in the area of the hinge connection of the sole plate 34, i.e. in the area of the horizontal transverse axis 18, and is connected to a cocking lever 29 which is supported for pivoting movement in the direction of double arrow 31 about a horizontal transverse axis 30 in the front region of the supporting means 14.

In the embodiment illustrated here, the clamping means 35 is a flat stainless steel band or strap supported within the sole plate 34 so as to be displaceable longitudinally in the direction of double arrow 36. The free rear end of the strap 35 is bent forwardly and upwardly in hook shape in order to be able to engage in a complementary transverse groove formed in the front sole 12 at the bottom, as may be gathered from FIG. 11.

If the strap 35 is made to be relatively rigid, it will end within the sole plate 34 ahead of the axis 18 of pivoting motion. In this event, the front end of the strap 35 preferably is connected to a flexible cable, especially a steel wire which is deflected in the area of the hinge axis and passes to the front through the casing of the binding to the cocking lever 29. The strap 35 may be biased into shoe release position by a spring (not shown) so that the strap 35, when shifting into shoe holding position, as indicated in FIG. 11, will move against this elastic bias. This occurs by forward downward pressure being exerted on the cocking lever 29 to bring it into the position according to FIG. 11. When in this position, the cocking lever 29 preferably adopts an ultra dead center position. If the cocking lever 29 is caused to give up that position the elastic bias mentioned which acts on the strap 35 will move the strap into shoe release position.

Also when the shoe heel 13 is lifted does the elastic bias in question become effective, although to a relatively little extent. This will cause return movement between the shoe and the ski or similar sports equipment.

The embodiment illustrated in FIG. 12 differs from the one according to FIG. 11 only in that the retaining means comprises a pliable strap 24 of stainless steel or a similar material which remains flexible permanently. This strap 24, at the same time, serves as clamping means for the sole. In the embodiment according to FIG. 13, the retaining means is embodied by a tensioning cable 25. This tensioning cable 25 engages in a transverse groove formed at the bottom of the front sole 12, in the rear region thereof. More specifically, this groove is formed as an undercut 26.

For particular structural embodiments of this retaining means reference is made to the applicant's own WO 96/23558.

The strap 24 has the additional advantage of co-defining the curvature of the front sole 12 in the region between the metatarsal zone 17 and the plantar arch. In this region the front sole 12 actually comes to rest on the strap 24. The tensioning cable 25 structure may be effective in similar manner if the tensioning cable is fully in contact with the bottom of the front sole 12 rather than being guided laterally past the front sole 12, as is the case with the embodiment of FIG. 13.

Moreover, at its front end the strap 24 of the embodiment shown in FIG. 12 is not supported pivotably but rather clamped firmly on the supporting means. The corresponding clamping block is designated by reference numeral 27. This clamping block 27 is supported so as to be movable back and forth in the direction of double arrow 22 in the casing of the binding, specifically within a support plate 21 associated with the front sole section. To this end it is coupled through a rigid link 28 to the locking lever 29 whose function was described in detail with reference to FIG. 11 above. In this manner the clamping block 27 and the sheet metal strap 24 connected to it are movable back and forth in longitudinal direction of the shoe by means of the cocking lever 29. In other words, the strap 24 can be moved from a shoe release position into a shoe retaining position, in accordance with FIG. 12, and vice versa. This reciprocating motion of the strap 24 is indicated in FIG. 12 by double arrow 36. The width of the strap 24 is less than the width of the support plate 21 and thus also less than the width of the front sole 12.

Of course, it would also be possible to pivot the front end of the strap 24 at the clamping block 27, i.e. to support it in the clamping block 27 so as to be pivotable about a horizontal transverse axis, similar to the transverse axis 18 in FIG. 11. Thus in the case of the embodiment shown in FIG. 12 the entire retaining means, i.e. the strap 24 with the associated clamping block 27 and the link 28 are moved back and forth in longitudinal direction of the shoe in order to either release the shoe or retain it on the supporting means 14.

The situation is quite similar with the embodiment of FIG. 13. With this embodiment the pivoting of the tensioning cable 25 at either side of the front sole 12 takes place at a respective upright lobe 32 of a U-shaped connecting member 33 which likewise is joined by way of a rigid link 28 to the locking lever 29 and movable in reciprocating fashion in longitudinal direction of the shoe by pivoting of the locking lever 29 about the axis 30. In this way the tensioning cable can be moved from a shoe retaining position, as illustrated in FIG. 13, into a shoe release position and vice versa.

It is also conceivable, in connection with the embodiments according to FIGS. 12 and 13, to subject the tensioning or clamping means 24, 25 and the corresponding linking elements 27, 32 to elastic bias in the direction of the shoe release position. If so, the links 28 need not be rigid. Instead, it will be possible to use flexible tensioning cables or wires. With the embodiments shown in FIGS. 12 and 13, of course, the locking lever 29, when in shoe retaining position, is located in a ultra dead center position.

Upon lifting of the shoe heel 13, both the tensioning cable 25 and the sheet metal strap 24 cause a return movement to take place between the shoe and the ski. This movement increases as the shoe heel 13 is lifted higher.

The embodiments of FIGS. 12 and 13 have the bending line or pivot axis 18 of the retaining means located below the front sole 12.

It may be advantageous with the embodiment according to FIG. 11 to place the sole plate 34 slightly deeper than the sole supporting surface 38 in the area of the supporting means 14 associated with the front sole section. That permits downward arching of the front sole 12 in the transitory region between the sole supporting surface 38 and the sole plate 34 when the shoe heel 13 is raised upwardly. This presents less of a problem with the embodiments according to FIGS. 12 and 13 because neither the tensioning cable 25 nor the strap 24 cause any obstruction of the arching of the front sole in downward direction as the shoe heel 13 is raised. That is true in particular of the embodiment shown in FIG. 13 where the tensioning cable is guided laterally past the front sole 12.

If the pivot axis 18 is to lie at the level of the front sole 12, the pivot axis 18 is defined by journals which are positioned laterally and whose axes are aligned at sole level. The journals then are arranged in lateral lobes of the casing of the binding, with the shoe, in particular the front sole thereof placed in between.

It goes without saying that the binding mentioned above is suitable not only for skis and similar pieces of snow gliding equipment but also for roller, cross-country, and touring skis.

Furthermore, it should be pointed out that the supporting means may comprise a locking means for an undercut, a transverse axis, or similar sole retaining element provided at the bottom of the sole in the metatarsal zone thereof. This transverse axis preferably is located in a recess formed at the bottom of the sole and is integrated with the sole. The locking means comprises a locking hook to grip behind the transverse axis in order to hold the front sole section firmly on the ski or on a plate of the binding arranged between the ski and the shoe. This hook-like retaining element is connected to a locking lever supported on the supporting means 14 for pivoting movement, preferably about a horizontal axis which extends transversely of the longitudinal direction of the ski. With such an embodiment, sole supporting elements 15 projecting over the sole, as indicated in FIGS. 11 to 13, may be dispensed with. That is why the supporting elements 15 which support the front sole section in upward direction are only indicated schematically in FIGS. 11 to 13. The pictorial presentation is meant to comprise such a supporting means as well.

It should be noted additionally with respect to FIGS. 5 to 10 that the toggle lever mechanism 47 is elastically biased by a helical compression spring. In the embodiments in question, the spring is supported at its rear end on the hinge connection between the front and rear levers and at its front end on the casing 46 of the binding. In the bottom ultra dead center position according to FIGS. 6 and 9 the helical compression spring 65 is compressed axially, as compared to the top ultra dead center position according to FIGS. 5 and 8. The elastic bias afforded by the helical compression spring 65 warrants the bistable positions of the levers 50, 51 and of the toggle lever mechanism 47 in the top and bottom ultra dead center positions. The ultra dead center line is defined by the connecting line between the rear pivot point of the rear lever 50 and the front pivot point of the front lever 51. It is also conceivable to connect a helical tension spring instead of the helical compression spring 65 between the rear pivot point of the rear lever 50, on the one hand, and the front pivot point of the front lever 51, on the other hand. The required bistable state of the toggle lever mechanism 47 can be achieved in that manner as well.

All the features disclosed in the application documents are claimed to be essential to the invention to the extent that they are novel over the state of the art, either individually or in combination.

LIST OF REFERENCE NUMERALS

10 ski
11 ski shoe
12 front sole
13 shoe heel
14 supporting means
15 wedges
16 side jaws
17 metatarsal zone
18 pivot axis
21 support plate
22 double arrow
24 strap
25 tensioning cable
26 undercut
27 clamping block
28 link
29 locking or cocking lever
30 axis
31 double arrow
32 lobe

33 connecting member
34 sole plate
35 clamping means (strap)
36 double arrow
38 sole support surface
39 clamping plate
39' deflector members
40 double arrow
41 oblong holes
42 lobes
43 double arrow
44 shoe arch
45 double arrow
46 casing of the binding
47 toggle lever mechanism
48 arrow
49 arrow
50 lever
51 lever
52 oblong passage
53 pivot axis
54 flat member
55 rivet connection
56 opening means
57 operating lever
58 arrow
59 wedge
60 wedge face
61 hinge axis
62 bearing bracket
63 linkage
64 hollow

What is claimed is:

1. A touring, telemark, or cross-country ski binding, comprising:

a supporting means configured to offer support in forward, upward and side directions to a front part of an associated shoe; and a retaining means connected to the supporting means and configured to hold the shoe in the supporting means such that a heel of the shoe can be raised freely, the retaining means including a clamping means selected from the group consisting of a tension cable and a clamping plate, the clamping means pivotably connected to the supporting means in an area of a metatarsal zone and configured to pivot about a pivot axis located above a lower surface of a front sole of the shoe, the clamping means configured to engage a front part of the shoe behind the metatarsal zone and in an area of a plantar arch or just ahead thereof wherein said supporting means and said retaining means cooperate to secure the portion of the sole forward of the pivot axis parallel with the supporting means.

2. The binding as claimed in claim 1, wherein the supporting of the front part of the shoe in upward direction takes place in an area of a front sole end, directly at the forward end of the front sole.

3. The binding as claimed in claim 1, wherein the supporting means firmly retains the shoe on the ski within a retaining area extending from a front sole end and approximately to the metatarsal zone.

4. The binding as claimed in claim 1, wherein the retaining means is mounted so as to be pivotable about an axis which extends transversely of a longitudinal direction of the shoe and approximately parallel to a tread of the sole, or being supported for pivoting motion, horizontally in the area of the metatarsal zone.

5. The binding as claimed in claim 4, wherein the pivot axis of the retaining means lies approximately at a level below the front sole of the associated shoe.

6. The binding as claimed in claim 1, wherein the supporting means comprises a toe iron including wedges projecting over a front sole section.

7. The binding as claimed in claim 1, wherein the supporting means is secured to a ski, and a connection of the retaining means to the supporting means is adjustable in height with respect to said ski.

8. The binding as claimed in claim 1, wherein the supporting means is secured to a ski, and a connection of the retaining means to the supporting means is adjustable longitudinally with respect to said ski.

9. A binding for a touring, telemark, or cross-country ski binding, comprising:

a supporting portion to offer support to a front part of an associated shoe in a forward, upwards and lateral direction with respect to said ski; and a retaining portion for holding said shoe in said supporting portion, and retaining portion comprising a clamping portion pivotably connected to the supporting portion in an area of the metetarsal zone and configured to engage a front part of said shoe at a location rearward of a metatarsal zone of said shoe and in an area of a plantar arch or just ahead thereof, said retaining portion permitting said metatarsal zone of said shoe to move upward with respect to an upper surface of said ski;

wherein said clamping portion is configured to pivot about a pivot axis located above the lower surface of the front sole of the shoe wherein said supporting portion and said retaining portion cooperate to secure the portion of the sole forward of the pivot axis parallel with the supporting portion.

* * * * *